United States Patent [19]

Stritzl et al.

[11] Patent Number: 4,804,201

[45] Date of Patent: Feb. 14, 1989

[54] SAFETY SKI BINDING

[75] Inventors: Karl Stritzl; Henry Freisinger, both of Vienna, Austria

[73] Assignee: TMC Corporation, Baar, Switzerland

[21] Appl. No.: 209,701

[22] Filed: Jun. 20, 1988

Related U.S. Application Data

[62] Division of Ser. No. 914,875, Oct. 3, 1986.

[30] Foreign Application Priority Data

Oct. 3, 1985 [AT] Austria ..... 2855/85

[51] Int. Cl.[4] ..... A63C 9/08

[52] U.S. Cl. ..... 280/618; 280/632

[58] Field of Search ..... 280/617, 618, 626, 631, 280/632

[56] References Cited

U.S. PATENT DOCUMENTS

| | | | |
|---|---|---|---|
| 4,307,895 | 12/1981 | Storandt et al. | 280/632 |
| 4,449,731 | 5/1984 | Knabel et al. | 280/632 |
| 4,475,743 | 10/1984 | Wittmann | 280/632 |
| 4,489,956 | 12/1984 | Jungkind | 280/632 |
| 4,625,991 | 12/1986 | Leichtfried | 280/632 |
| 4,758,017 | 7/1988 | Stritzl et al. | 280/618 |

FOREIGN PATENT DOCUMENTS

| | | |
|---|---|---|
| 3102010 | 9/1982 | Fed. Rep. of Germany . |
| 3342155 | 5/1985 | Fed. Rep. of Germany . |

*Primary Examiner*—David M. Mitchell
*Assistant Examiner*—Michael Mar
*Attorney, Agent, or Firm*—Flynn, Thiel, Boutell & Tanis

[57] ABSTRACT

A safety ski binding having a sole plate which is pivotally supported on a ski-fixed pivot pin in a horizontal plane, however, is secured against lifting off from the ski. The sole plate has a front jaw at its front end and a heel holder provided with a housing at its rear end. The heel holder has a sole holder which is pivotal upwardly about a transversely extending axle on the housing against the force of a pressure spring. The heel holder also carries a roller which is loaded by at least one further pressure spring on a control lever, with which roller is associated a cam surface arranged on a ski-fixed member. The pressure springs for controlling the vertical release and the ones for controlling the lateral release can thereby either be arranged among one another or nested into one another.

8 Claims, 6 Drawing Sheets

FIG. 1
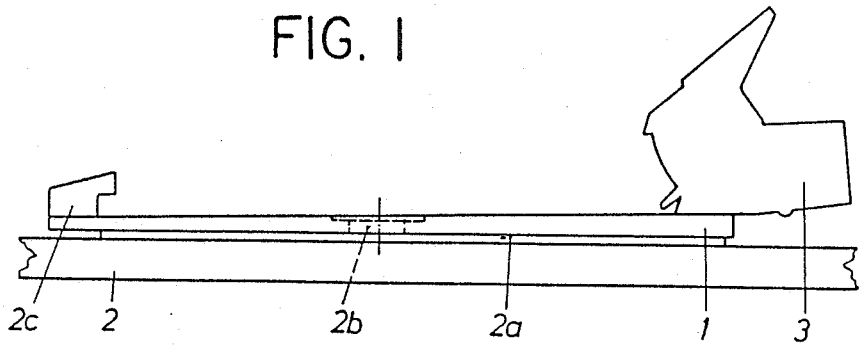
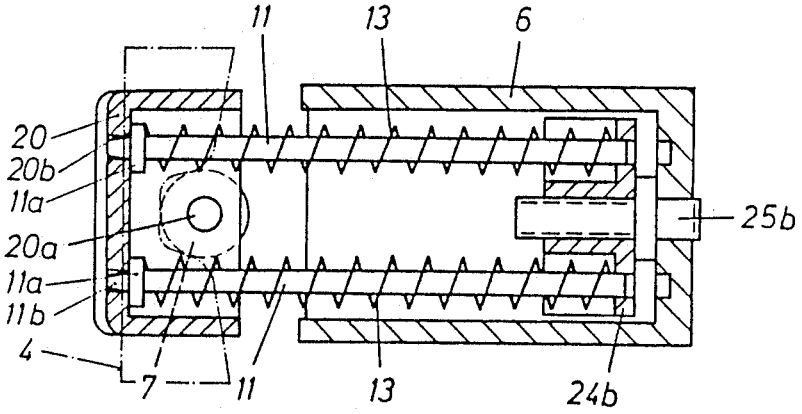
FIG. 6

SAFETY SKI BINDING

This is a division of Ser. No. 914,875, filed Oct. 3, 1986.

FIELD OF THE INVENTION

The invention relates to a safety ski binding having a sole plate which is pivotally supported on a ski-fixed pivot pin and has a front jaw at one end and a heel holder at the other end.

BACKGROUND OF THE INVENTION

A known design of this type, as it is described in German OS No. 31 02 010, uses two pairs of toggle levers to lock the sole holder in the skiing position. However, these are difficult to mount. Furthermore, the known heel holder is relatively complicated in its construction.

The purpose of the invention is to overcome the disadvantages of the known construction and to provide a safety ski binding which can be easily manufactured and mounted.

Two constructions are available for attaining the mentioned purpose. A compact construction of the heel holder is thereby assured in both cases and its mounting is simplified. Furthermore, a separation of the functions of the springs is achieved.

A further characteristic of the invention permits that the piston, which is loaded by a spring for controlling the vertical release, can act directly onto the locking lever.

Further, the provision of two guide rods for the pressure springs, which control the release in a horizontal plane, are fixed to the control lever. The points of engagement of the two springs on the control lever are exactly defined.

Further, the invention is distinguished by the force of the spring, which is designated for controlling the pivoting of the sole holder in the vertical direction, being transmitted to both sides of the control lever and onto the locking lever. Thus, the spring can engage centrally on the control lever for controlling the release in a horizontal plane, which has advantages with respect to facilitating a symmetrical design.

A further feature of the invention locates the adjusting screw, which serves to adjust the initial tension of the pressure spring loading the roller controlling the release in a horizontal plane, so that it can be adjusted only by a trained mechanic. An adjusting of the adjusting screw by a layperson is thus practically impossible. With this accidents caused by incorrect adjustment of the spring can be prevented.

BRIEF DESCRIPTION OF THE DRAWINGS

Two exemplary embodiments of the subject matter of the invention are illustrated in the drawings, wherein:

FIG. 1 is a side view of the entire safety ski binding;

FIG. 6 is a cross-sectional view taken along the line III—III of FIG. 2;

DETAILED DESCRIPTION

Figure 2:
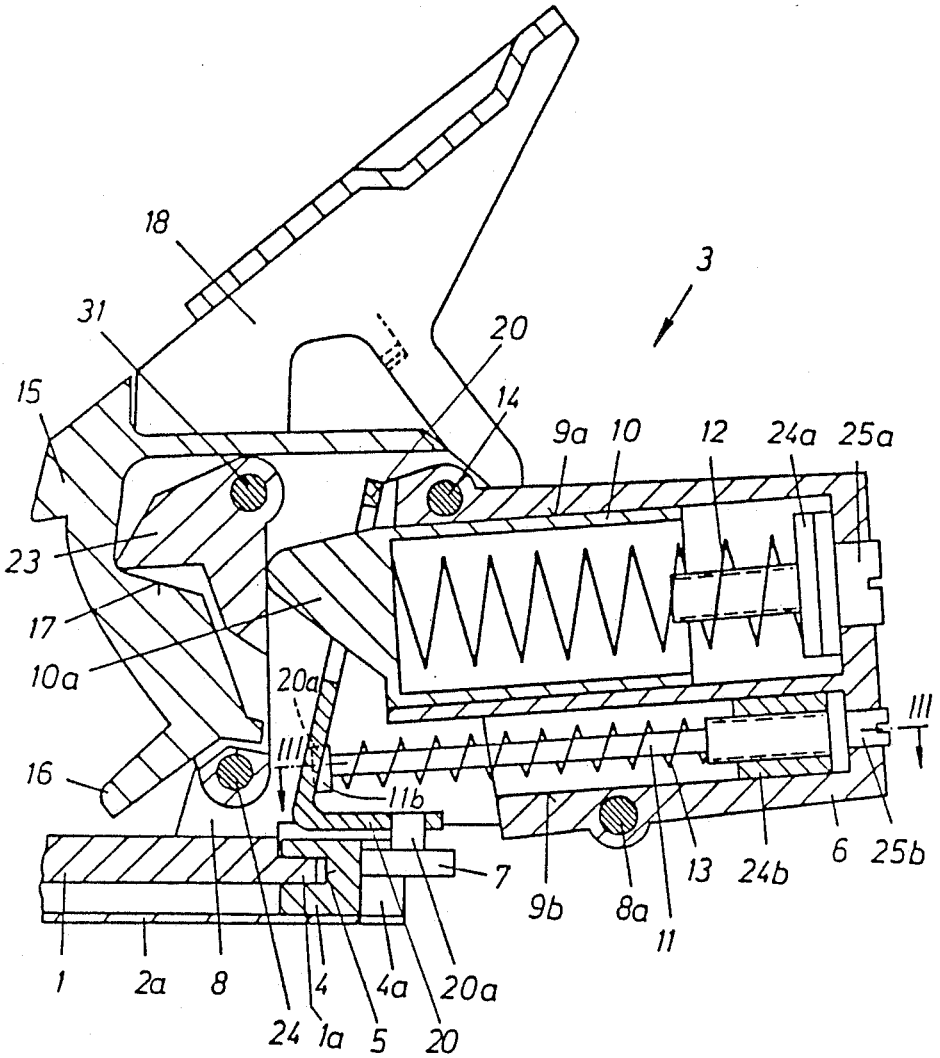
FIG. 2 is a vertical longitudinal cross-sectional view of the heel holder-of the safety ski binding according to a first embodiment and in the skiing position.
Figure 3:
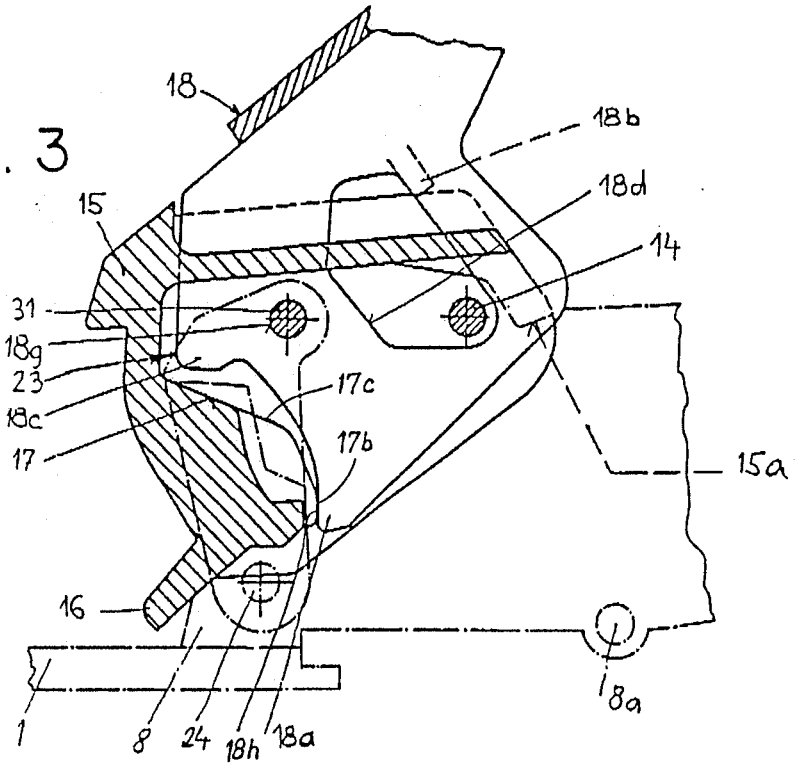
FIGS. 3 to 5 are cross-sectional views similar to FIG. 2 but showing the cooperating structures on the sole holder and the release lever in a plane behind the cross-sectional view or FIG. 2.
Figure 4:
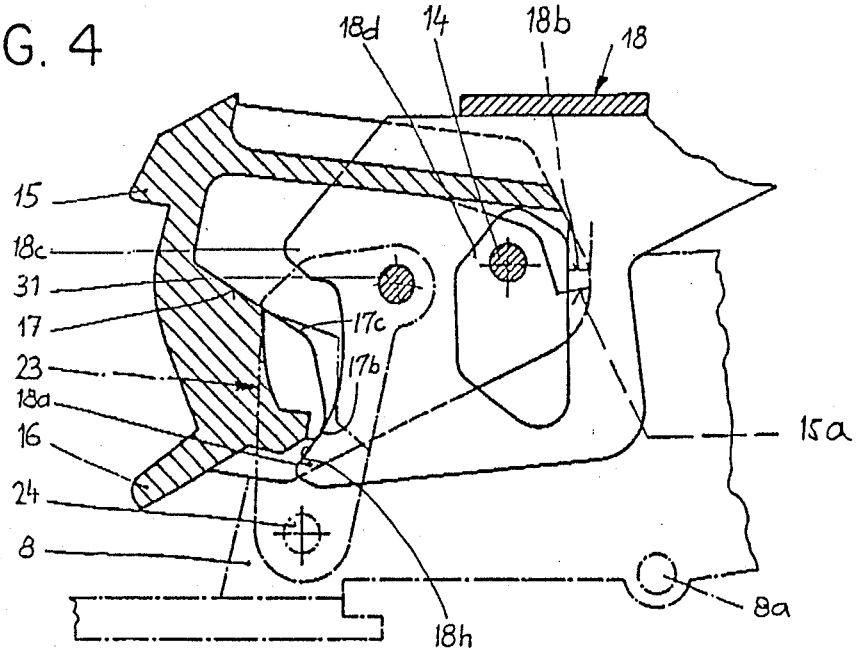
Figure 5:
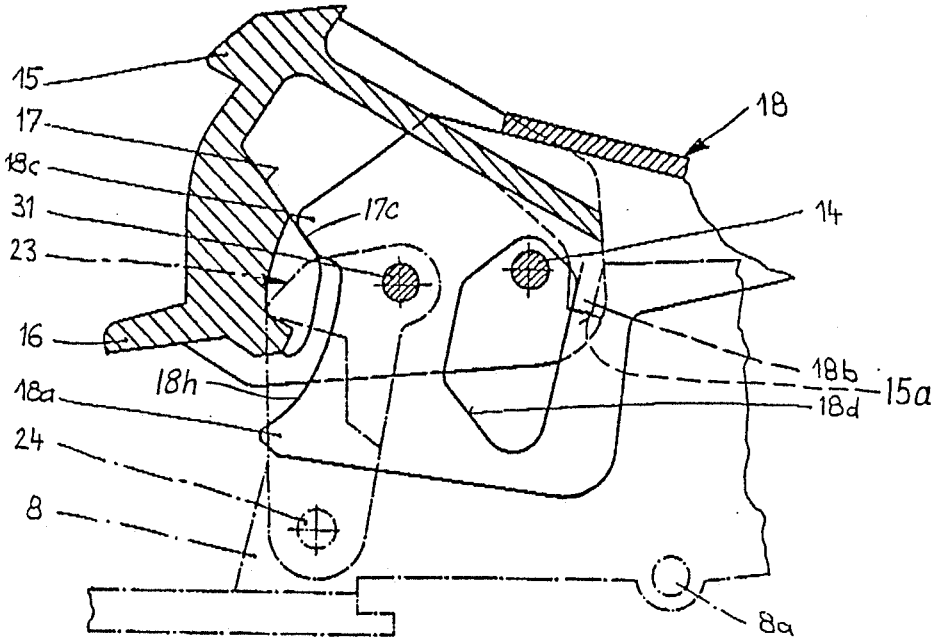

The safety ski binding illustrated in FIGS. 1 to 7 is a so-called plate binding. A base plate 2*a*, which carries a pivot pin 2*b*, is provided on a ski 2. A sole plate 1 is pivotally supported about the pivot pin 2*b* in a horizontal plane. A front jaw 2*c* is mounted on the front end of the sole plate 1 and is not the subject matter of the present invention. A heel holder is mounted on the sole plate 1 at the rear end thereof and is identified in its entirety by the reference numeral 3. The heel holder 3 has a housing 6. Furthermore a member 4 is secured to the base plate 2*a*. The member 4 has a cam surface 4*a* which is approximately V-shaped in the top view and on its side remote from the pivot pin 2*b*. A roller 7 is guided on the cam surface 4*a*. A groove 5, which is circular in the top view, is provided on the front facing side of the member 4. A rib la is provided on the sole plate 1 and slidingly extends into the groove 5.

A pair of laterally space and symmetrically oriented extensions 8 (only one being shown in FIG. 2) are secured to the upper surface of the rear end portion of the sole plate 1 and extend parallel rearwardly from the sole plate 1*a*. The housing 6 of the heel holder 3 is positioned between the extensions 8 and is fastened thereto by means of a rivet 8*a*. Two recesses 9*a* and 9*b* are furthermore provided in the housing 6. The recess 9*a* has a pressure spring 12 mounted therein whereas the recess 9*b* has two pressure springs 13 mounted therein. The pressure spring 12 acts onto a piston 10, which is reciprocally guided in the recess 9*a*. A pair of parallel rods 11 are provided in the recess 9*b* and are supported on the housing 6 for reciprocal movement. Each of the two pressure springs 13 encircle a rod 11 and is compressed between the head 11*a* of each rod 11 and the housing 6. In order to be able to adjust the initial tension of the three pressure springs 12 and 13, they both engage at one end thereof a spring washer 24*a* (spring 12) or a yoke 24*b* (springs 13), the longitudinal position of which elements can be adjusted by means of screws 25*a* and 25*b* in direction of the axis of the recesses 9*a* and 9*b*.

A transverse bore is provided in the housing 6 above the recess 9*a*, in which bore is supported an axle 14. A unit consisting of a sole holder 15 and a stepping spur 16 is hingedly secured to the axle 14. A cam surface 17 is provided on the inside of the unit. The axle 14 carries furthermore a control lever 20, at the lower end of which is supported an axle 20*a* for the roller 7. The control lever 20 has an approximate U-shape in cross-section (see FIG. 3), whereby the spacing between the laterally spaced legs thereof has an opening through which the nose 10*a* on the piston 10 passes. The piston 10 is urged by the pressure spring 12 against the rear boundary surface of a locking lever 23, the pivot axle 24 for which is supported on and extends between the extensions 8. The front side of the locking lever 23 rests on the cam surface 17. Two bores 20*b* (FIG. 3) are furthermore provided in the control lever 20. The forward ends 11*b* of the rods 11 are received in the bores 20*b*.

An axle 31, on which is supported a release lever 18, is provided in the upper region of the locking lever 23. Details of the release lever 18 can be taken from FIG. 7.

The release lever 18 is constructed approximately U-shaped, as viewed from the front, and has in the area of its two legs hooklike projections 18*a*, which are operatively received in conforming recesses in the sole holder 15. The release lever 18 also has on its two legs two laterally outwardly extending shoulders 18*b* which, during opening after exceeding the release point, cooperate with congruent surfaces 15*a* on the sole holder. Finally, two shoulders 18*c* are provided in the upper region of the two legs of the release lever 18 and are associated with counter surfaces 17*c* on the sole holder 15 for purposes of facilitating a closing of the sole holder 15 and, when the sole holder 15 is closed, of stabilizing the release lever 18. A large opening 18*d* is provided in each of the two legs of the release lever 18 in the center area, which opening facilitates a free positioning of the axle 14. The web 18*e* of the release lever 18 extending between the legs carries an indentation 18*f*, which is designated for the engagement of the tip of a ski pole. Axially aligned bores 18*g* are provided in the legs of the release lever 18 and receive therein the axle 31.

The sole holder 15 is urged by the pressure spring 12 to the skiing position illustrated in FIG. 2. The two pressure springs 13 cause the heel holder 3 to be yieldably locked against a pivoting movement in a plane parallel with respect to the upper side of the ski and about the axis of the pivot pin 2*b*.

If a frontal fall of the skier occurs during skiing, the pressure spring 12 is compressed, and the unit of sole holder 15 and stepping spur 16 pivot clockwise in FIG. 2, which results in a release of the ski shoe. The free end of the locking lever 23 slides thereby along the cam surface 17 and moves the piston 10 back through its nose 10*a* against the urging of the spring 12.

If, however, a purely twisting fall occurs during skiing, then the roller 7 rolls along the cam surface 4*a*, which causes the control lever 20 to move the two rods 11 to the right in FIG. 2, which results in a compression of the two pressure springs 13. The ski shoe is not released during a purely twisting fall.

The two operations discussed above are superposed during a combined forward and twisting fall. Of course, all three pressure springs 12, 13 are thereby compressed.

The release lever 18 is pivoted clockwise in FIG. 2 during a voluntary release. The end 18*a* of the release lever 18, particularly a forward facing surface 18*h* thereon, biases a rearwardly facing cam surface 17*b*, which causes a lifting of the sole holder 15, thereby a sliding of the locking lever 23 along the cam surface 17 and a compressing of the pressure spring 12. As soon as the release point of the heel holder 3 is reached, the sole holder 15 is swung into the open position by the decompressing pressure spring 12 (see FIGS. 3–5). When the sole holder 15 has reached a certain opening angle its opening is further supported by the contact of the extending shoulders 18*b* of the release lever 18 with the congruent surfaces 15*a* of the sole holder 15.

To close the sole holder upon a reverse pivoting of the release lever 18 two shoulders 18*c* are provided in the upper region of the two legs of the release lever 18, which shoulders 18*c* are associated with countersurfaces 17*c* on the sole holder 15.

Figure 7:
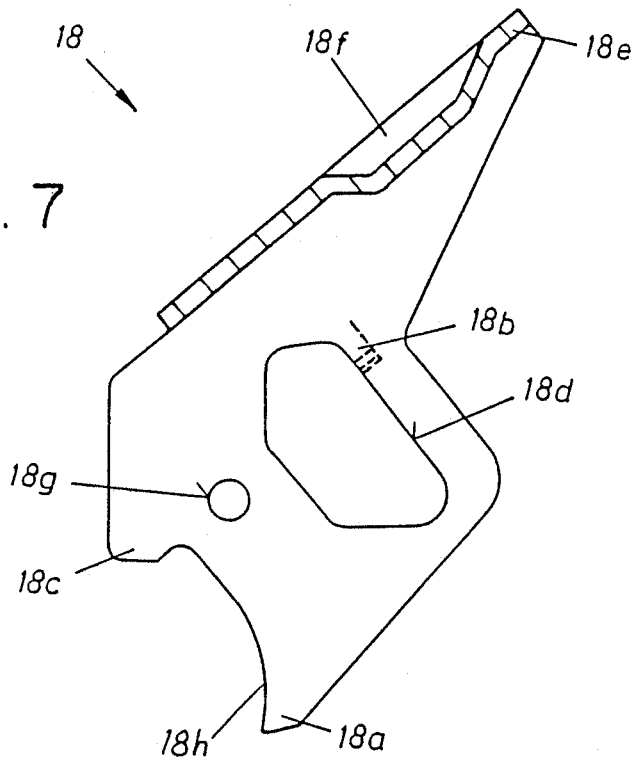
FIG. 7 is a vertical longitudinal cross-sectional view of the release lever of the heel holder.
Figure 8:
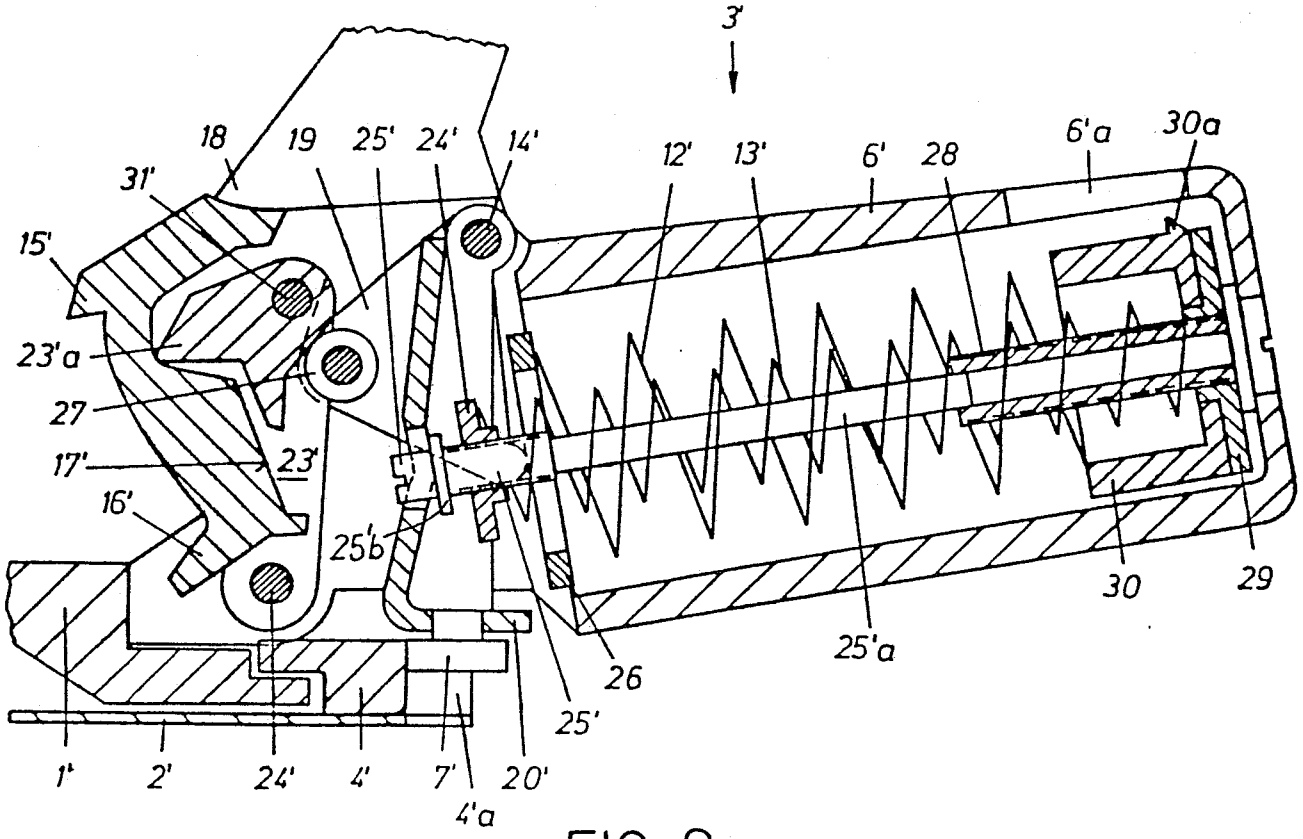
FIG. 8 shows a second exemplary embodiment of a heel holder, which is also in skiing position, in a vertical longitudinal cross-sectional view.

The release lever 18 illustrated in FIG. 7 is not limited in its use to the exemplary embodiment illustrated in FIG. 2, as it can also be used in the exemplary embodiment according to FIG. 8.

The embodiment of a heel holder 3' illustrated in FIG. 8 is similar to the first-described embodiment. However, only two pressure springs 12' and 13' are nested coaxially into one another in a single recess in the housing 6'. The inner pressure spring 13' is supported by means of a spring washer 24' and an adjusting screw 25' on the slightly bent control lever 20', which is hingedly secured to the housing 6' and carries the roller 7'. Whereas the other pressure spring 12' is supported through a pressure ring 26 connected between a two arm intermediate member 19, the arms of which are approximately triangularly shaped in the side view and carry a roller 27 straddled therebetween. The arms of the intermediate member 19 grips laterally around the control lever 20' and are also pivotally supported on the axle 14'. The roller 27 rolls along the back side of the upper region of the locking lever 23' adjacent the axle 31' which supports the release lever 18. Reference numeral 23'*a* identifies the frontwardly extending nose of the locking lever 23', which nose rests on the cam surface 17'.

An adjusting screw 25 is extended at 25'*a* toward the rear end of the ski. The extension 25'*a* is guided in an axially extending hollow sleeve 28 which has an external thread and is supported against the back wall of the housing 6'. A spring washer 29 is screwed onto the externally threaded part of the sleeve 28. A pressure ring 30 is provided between the spring washer 29 and the pressure spring 12'. The pressure ring 30 carries a mark 30*a* thereon. The position of this mark 30*a* and thus the initial tension of the pressure spring 12' can be read through a window 6'*a* in the housing 6', which window has a scale thereon.

During a frontal fall of the skier, only the outer pressure spring 12' is compressed and the sole holder 15' is pivoted about the axle 14'. Whereas if a twisting fall of the skier occurs, then the roller 7' moves along the cam surface 4'*a*, which results in a compression of the inner pressure spring 13'. The collar 25'*b* of the adjusting screw 25' rests then snugly with its lower half on the control lever 20'.

Only the spring 12' is compressed during a voluntary release of the binding. The functions of the two pressure springs 12' and 13 which are nested into one another are thus here also separate from one another.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a safety ski binding comprising a sole plate pivotally supported on a ski-fixed pivot pin for movement in a horizontal plane, said pivot pin preventing said sole plate from lifting off from front end and the ski, said sole plate having a front jaw at its a heel holder provided with a housing at its rear end, said heel holder having a sole holder pivotally supported on said housing about a transversely extending axle against the force of a first pressure spring, said housing having a control with a roller thereon, said control lever being loaded by a second pressure spring, with which roller is associated a cam surface arranged on a ski-fixed member, said first and second pressure springs being nested coaxially into one another in said housing, the improvement comprising wherein an outer one of aid pressure springs for controlling elevational release rests on a pressure ring provided on an intermediate member, which intermediate member has a nose means thereon engaged with a single locking lever.

2. A binding according to claim 1, wherein said intermediate member is designed approximately triangularly shaped in a side view thereof, is hingedly secured to the housing in its upper region and carries said nose means at its front end.

3. A binding according to claim 1, where intermediate member grips laterally around said control lever, which control lever in its center area has a opening for receiving the end of an adjusting screw for facilitating an adjusting of the initial tension of the inner pressure spring which load said nose means.

4. A binding according to claim 3, wherein said control lever has a bend in the area of said opening therein, which bend permits a snug contact of a collar on said adjusting screw with said control lever in the center position and in every and position thereof.

5. A binding according to claim 1, wherein said locking lever carries an axle for a release lever in its upper end area.

6. A binding according to claim 5, wherein said release lever has two hooklike projections which are operatively connected with corresponding recess in the sole holder.

7. A binding according to claim 5, wherein release lever carries two lateral shoulders designated for pivoting said sole holder, after exceeding the release point, into its stepping-in position.

8. A binding according to claim 5, wherein said release lever has in its upper front region two further shoulders, with which are associated countersurfaces on said sole holder for facilitating a closing of said binding.

* * * * *

UNITED STATES PATENT AND TRADEMARK OFFICE

CERTIFICATE OF CORRECTION

PATENT NO. : 4 804 201

DATED : February 14, 1989

INVENTOR(S) : Karl STRITZL et al.

It is certified that error appears in the above-identified patent and that said Letters Patent is hereby corrected as shown below:

Column 4, line 58; delete "front end and".
line 59; after "its" insert ---front end and---.
line 63; after "control" insert ---lever---.
Column 5, line 1; change "aid" to ---said---.
line 11; change "where" to ---wherein said---.
line 13; change "a" to ---an---.

Signed and Sealed this

Fourteenth Day of November, 1989

*Attest:*

JEFFREY M. SAMUELS

*Attesting Officer* *Acting Commissioner of Patents and Trademarks*